US005625387A

United States Patent [19]

Moon

[11] Patent Number: 5,625,387

[45] Date of Patent: Apr. 29, 1997

[54] GRAY VOLTAGE GENERATOR FOR LIQUID CRYSTAL DISPLAY CAPABLE OF CONTROLLING A VIEWING ANGLE

[75] Inventor: Seung H. Moon, Seoul, Rep. of Korea

[73] Assignee: Samsung Electronics Co., Ltd., Suwon, Rep. of Korea

[21] Appl. No.: 378,274

[22] Filed: Jan. 26, 1995

[30] Foreign Application Priority Data

Jan. 26, 1994 [KR] Rep. of Korea ..... 94-1363

[51] Int. Cl.[6] ..... G09G 5/00

[52] U.S. Cl. ..... 345/211; 345/89; 345/209; 345/147

[58] Field of Search ..... 345/211, 209, 345/89, 99, 212, 63, 77, 96, 79, 54, 147, 94, 95, 100

[56] References Cited

U.S. PATENT DOCUMENTS

| | | | |
|---|---|---|---|
| 4,427,978 | 1/1984 | Williams | 345/89 |
| 4,769,639 | 9/1988 | Kawamura et al. | 345/89 |
| 5,012,384 | 4/1991 | Chew | 361/159 |
| 5,061,920 | 10/1991 | Nelson | 345/89 |
| 5,122,790 | 6/1992 | Yasuda et al. | 345/209 |
| 5,229,761 | 7/1993 | Fuse | 345/211 |
| 5,283,477 | 2/1994 | Shibata | 345/211 |
| 5,329,288 | 7/1994 | Kim | 345/63 |
| 5,384,516 | 1/1995 | Kawabata et al. | 315/160 |
| 5,389,952 | 2/1995 | Kikinis | 345/212 |
| 5,404,150 | 4/1995 | Murata | 345/211 |
| 5,406,308 | 4/1995 | Shiki | 345/99 |
| 5,414,443 | 5/1995 | Kanatani et al. | 345/95 |
| 5,442,370 | 8/1995 | Yamazaki et al. | 345/94 |

*Primary Examiner*—Mark R. Powell
*Assistant Examiner*—Martin Loui
*Attorney, Agent, or Firm*—Cushman Darby & Cushman, IP Group of Pillsbury Madison & Sutro LLP

[57] ABSTRACT

A gray voltage generator for liquid crystal display can control a viewing angle of the liquid crystal via a shift of a gray reference voltage by adjusting a size of the gray reference voltage level, can compensate kick back voltage and threshold voltage of the liquid crystal by fine adjustment of the gray reference voltage level, and can prevent an abnormal screen displayed in the liquid crystal display during an internal setup time when a video signal is not produced after power is applied to electrical equipment including its liquid crystal display.

11 Claims, 4 Drawing Sheets

GRAY VOLTAGE GENERATOR FOR LIQUID CRYSTAL DISPLAY CAPABLE OF CONTROLLING A VIEWING ANGLE

BACKGROUND OF THE INVENTION

1. Field of the Invention

The present invention relates to a gray voltage generator for a liquid crystal display capable of controlling a viewing angle. More particularly, the present invention relates to a gray voltage generator for a liquid crystal display which can produce a gray voltage that is applied to a liquid crystal panel and control a viewing angle of the liquid crystal.

2. Description of the Prior Art

Conventionally, a driving method which periodically inverts an applied voltage of a liquid crystal panel is used because the liquid crystals become degraded and a noninverted DC voltage has a bad influence on durability of the liquid crystal panel.

Reverse driving methods can be generally classified as a first method by which only a gray voltage is inverted on the basis of the potential of a common electrode and a second method by which the voltage of the common electrode and the gray voltage are both inverted on the basis of predetermined potential. The latter, especially, is called a common electrode reverse method.

The common electrode driving method has an advantage that a compact and cheap driver integrated circuit made by a 5 V complementary metal oxide semiconductor process may be used since reverse width can be reduced to a half by the common electrode reverse method compared with the first method mentioned above.

Regarding the common electrode reverse method, a paper, "8.4-inch Color TFT-LCD with 0.27 mm Pixel Pitch Aims at Industry Standard" by Yoshiharu Kanatani on Pages 68 to 72 of NICKEL ELECTRONICS ASIA/October 1992 proposed the use of a blacklight, a liquid crystal panel, a driver LSI and the common electrode reverse driving method to embody low power consumption and to be operated by a portable 5 V power supply.

The conventional gray voltage generator according to the common electrode reverse method will be explained with reference to the attached drawings.

FIG. 1 is a schematic illustration of a conventional liquid crystal display, and FIG. 2 is a detailed circuit diagram illustrating a conventional gray voltage generator for liquid crystal display.

Referring to FIG. 1, a video signals RGB, horizontal and vertical synchronous signals HSYNC and VSYNC, and a clock signal SCLK are inputted to a microcontroller of the conventional liquid crystal display, and a data signal DATA, various signals CTL1 and CTL2, and a reverse signal RVS are produced. The reverse signal RVS has an inverting period which enables voltage applied to a liquid crystal panel 5 by a source driver 3 to be reversed for each frame.

The reverse signal RVS is inputted to a gray voltage generator 2 and 8 levels of gray voltage are produced, and the 8 gray voltage levels are applied to the source driver 3.

The signal CTL2 from the microcontroller 1 is applied to a gate driver 4, and a gate electrode of each line in the liquid crystal panel 5 is sequentially turned ON by a driving voltage applied in response to the signal CTL2. One of the 8 gray voltage levels in the gray voltage generator 2 corresponding to the data signal inputted by the signal CTL1 is selected in the source driver 3 and is applied to the liquid crystal display 5 for each line.

When the corresponding TFT is turned ON by the gate driver 4, desired information may be displayed in each pixel of the liquid crystal panel 5 by applying the gray voltage applied from the source driver 3 and voltage corresponding to potential difference of a common electrode VCOM, thereby determining optical transmittivity of the liquid crystal corresponding to the applied voltage.

At this point, the 8 gray voltage level signals from the gray voltage generator 2 are reversed per frame according to a reverse period of the reverse signal RVS from the microcontroller, and the voltage applied to the liquid crystal of each pixel in the liquid crystal panel 5 is also reversed per frame.

Referring to FIG. 2, the operation of the gray voltage generator 2 will be explained. The inputted reverse signal RVS is connected to resistor R21 and then inverted and amplified, or amplified respectively, by operational amplifiers OP1 and OP2. One terminal of resistor R22 is connected to the non-inverting input of OP1, while the other terminal of resistor R22 is connected to the ground. A reverse phase signal VB of the inputted signal RVS is produced from the operational amplifier OP1, and an in-phase signal VA of the inputted signal RVS is produced from the operational amplifier OP2. Resistor R23 provides feedback from VB to the inverting input of OP1. Resistor R24 provides feedback from VA to the inverting input of OP2.

The output signals VA and VB from the operational amplifiers OP1 and OP2 are applied to opposite terminals of seven serially connected resistors R1 to R7. The potential difference between the output signals VA and VB from two operational amplifiers OP1 and OP2 is divided by each resistor R1 to R7, and the 8 gray voltage levels formed sequentially are produced from the output terminals of each resistor R1 to R7.

The 8 gray voltage levels are also reversed by inversion of the output signal VA and VB from the operational amplifiers OP1 and OP2 in the output terminals of each resistor R1 to R7 at every reverse period.

However, the conventional gray voltage generator has a disadvantage in that the control of the viewing angle of the liquid crystal, which corresponds to the shift of the gray voltage, can not be made because the output signal of each operational amplifier, sets, the gray voltage without regard to viewing angle differences.

In addition, the conventional gray voltage generator has other disadvantages in that the gray voltage of the gray voltage generator does not take into account the characteristics of the liquid crystal, such as different threshhold voltages of different liquid crystals, and the gray voltage may drop by as much as a kick back voltage when applied to the liquid crystal.

SUMMARY OF THE INVENTION

The present invention overcomes the problems and disadvantages of the prior art by providing a gray voltage generator for a liquid crystal display which can control a viewing angle of liquid crystal by a shift of a gray reference voltage by adjusting a size of the gray reference voltage, and which can compensate for the kick back voltage and the threshold voltage of the liquid crystal by fine adjustment of the gray reference voltage level.

Another object of the present invention is to provide a gray voltage generator for a liquid crystal display capable of controlling a viewing angle which can prevent an abnormal screen displayed in a liquid crystal display during an internal setup time when a video signal is not produced, but after power is applied to a computer, a camcorder and so on when the liquid crystal display is operated.

To achieve the objects and in accordance with the purpose of the invention, as embodied and broadly described herein, the gray voltage generator for a liquid crystal display capable of controlling a viewing angle of the present invention comprises first means for inverting and amplifying a reverse signal from a microcontroller in a liquid crystal display to produce a reverse phase signal having a first controlled voltage level; second means for amplifying the reverse signal from the microcontroller in the liquid crystal display to produce an in-phase signal having a second controlled voltage level; and third means which receives the reverse phase signals and the in phase signals at opposite terminals for producing a plurality gray voltage, each having a sequentially different potential using a plurality of serially connected resistors.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENT

Reference will now be made in detail to a preferred embodiment of the present invention, an example of which is illustrated in the accompanying drawings. Wherever possible, the same reference numbers will be used throughout the drawings to refer to the same or like parts.

Figure 1:
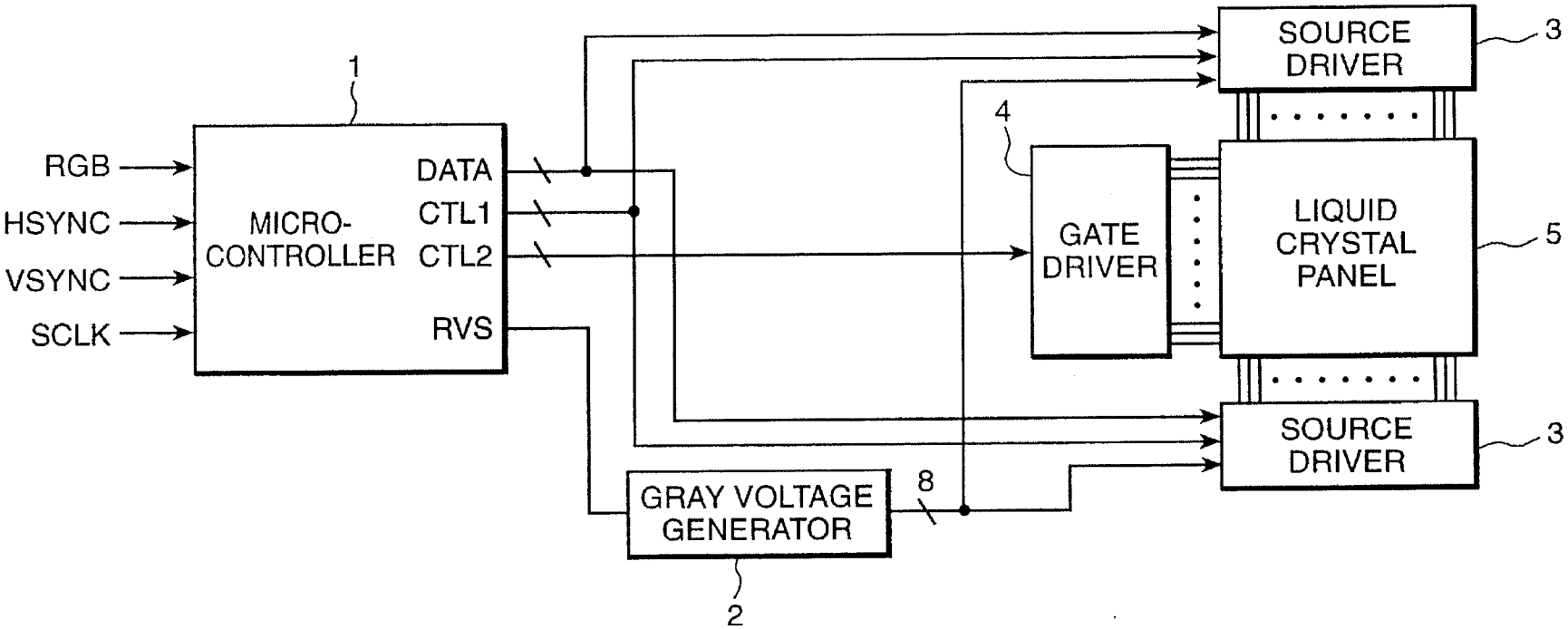
Fig. 1 (PRIOR ART)
FIG. 1 is a schematic illustration of a conventional liquid crystal display.
Figure 2:
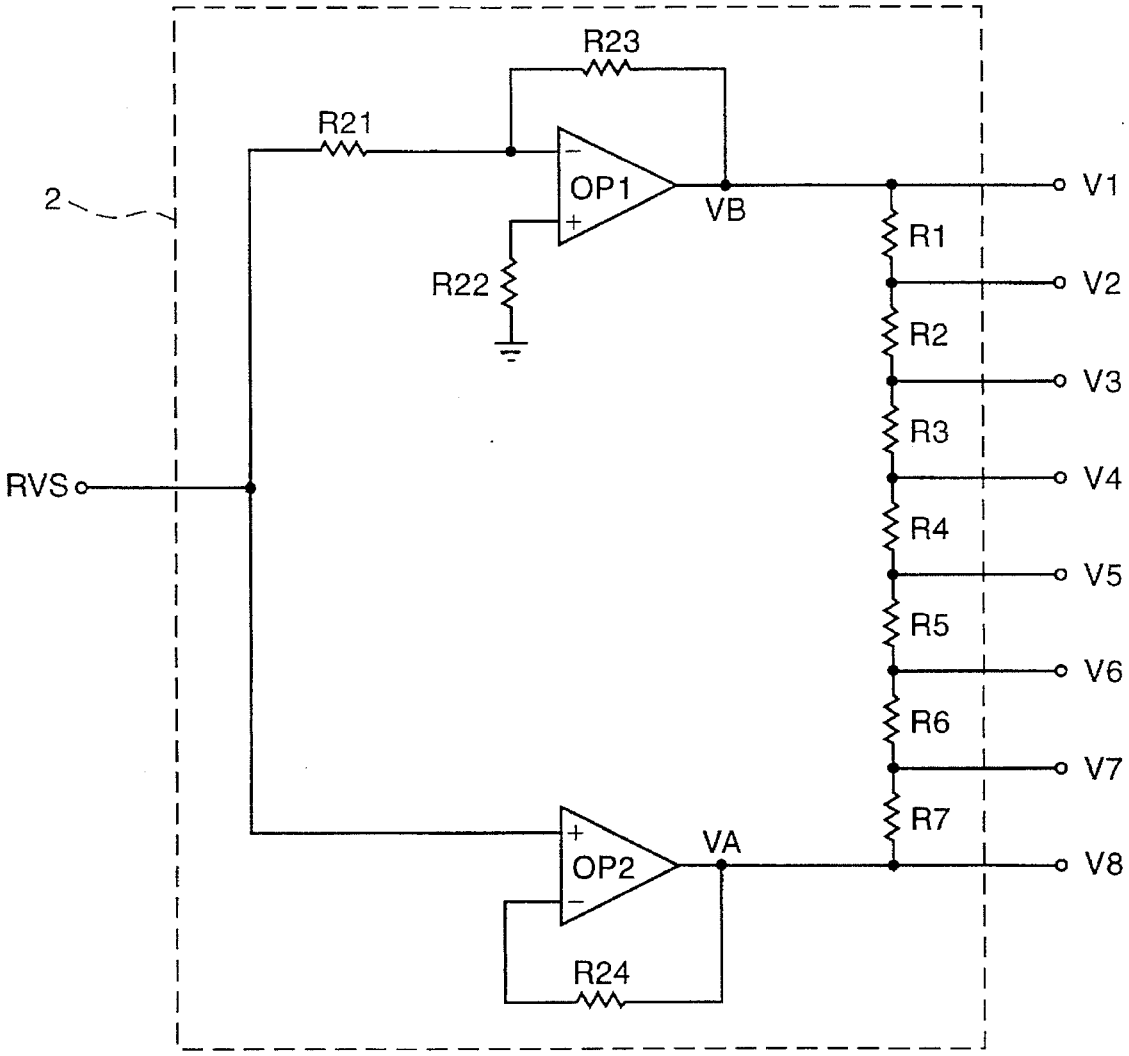
Fig. 2 (PRIOR ART)
FIG. 2 is a detailed circuit diagram illustrating a conventional gray voltage generator for a liquid crystal display.
Figure 3:
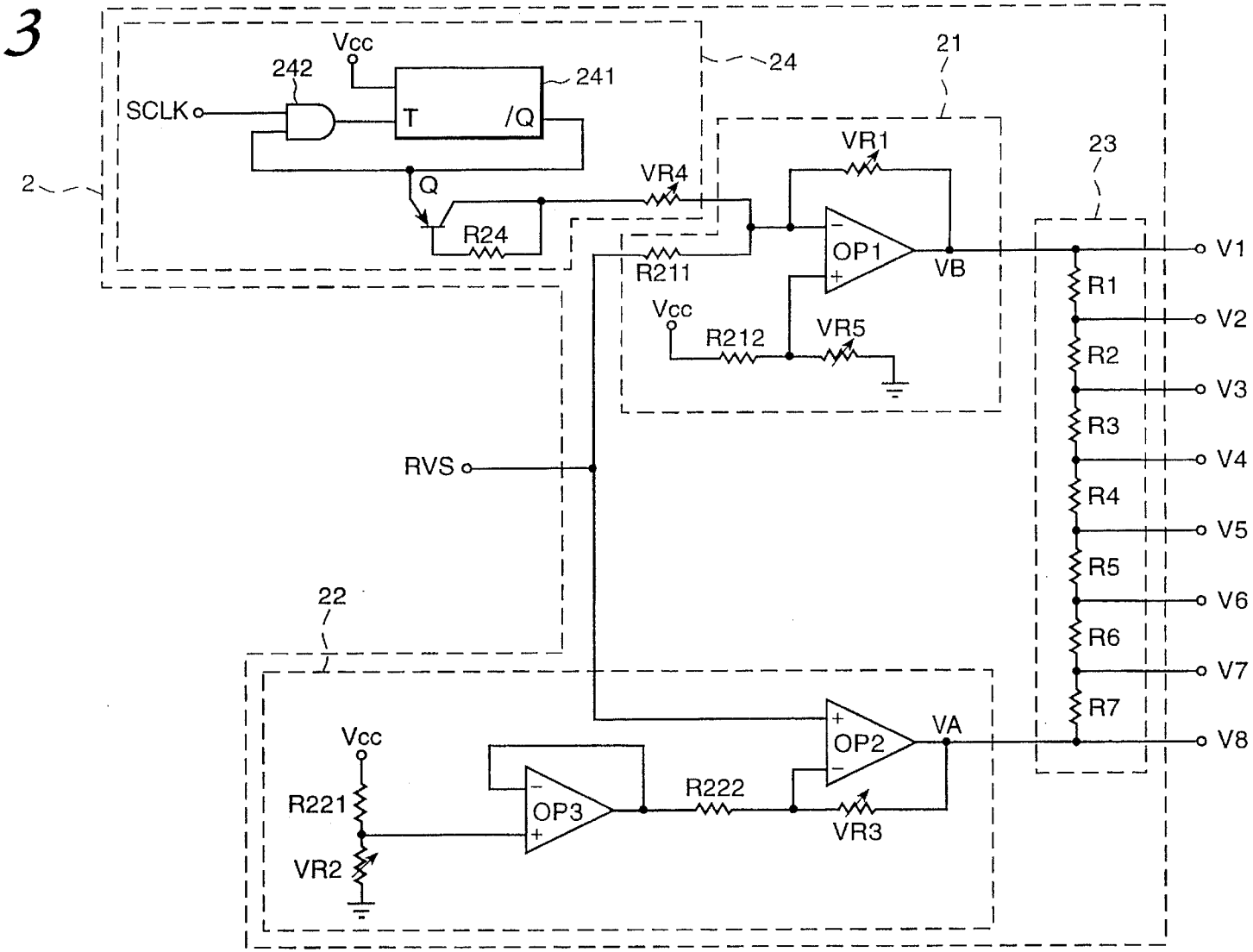
FIG. 3 is a detailed circuit diagram illustrating a gray voltage generator for a liquid crystal display capable of controlling a viewing angle according to a preferred embodiment of the present invention.

In FIG. 3, gray voltage generator for a liquid crystal display capable of controlling a viewing angle is shown to include an early screen controller 24 in which a clock signal SCLK and an output terminal of a T-flip-flop 241 are inputted to an AND element 242. An output terminal of the AND gate 242 is connected to an input terminal of the T-flip-flop 241, the output terminal of the T-flip-flop is connected to an emitter terminal of a transistor Q, a resistor R24 is connected between a collector terminal and a base terminal of the transistor Q, and a variable resistor VR4 is connected to the collector of the transistor Q. An inverting amplifier 21 has one terminal of the variable resistor VR4 in the early screen controller 24 connected to an inverting input terminal of an operational amplifier OP1, a resistor R211 to which a reverse signal RVS is applied is connected to the inverting input terminal of the operational amplifier OP1, a resistor 212 to which power VCC is applied is connected to one terminal of a variable resistor VR5 with the other terminal connected to ground. A contact point between the resistor R212 and the variable resistor VR5 is connected to a noninverting input terminal of the operational amplifier OP1, and a variable resistor VR1 is connected between the inverting input terminal and the output terminal of the operational amplifier OP1. A noninverting amplifier 22 in which a resistor R221 to which power VCC is applied is connected to a variable resistor VR2, a contact point of the resistor R221 and the variable resistor VR2 is connected to a noninverting input terminal of an operational amplifier OP3, an output terminal of the operational amplifier OP3 is connected to the inverting input terminal of the operational amplifier OP2 through a resistor 222, a variable resistor VR3 is connected between the inverting input terminal and the output terminal of the operational amplifier OP2, and the reverse signal RVS is applied to the noninverting input terminal of the operational amplifier OP2. A voltage divider 23 in which seven resistors R1 to R7 are serially connected between the output terminal of the operational amplifier OP1 and the output terminal of the operational amplifier OP2, and gray voltage V1 to V7 is produced from both terminals of each resistor R1 to R7.

As described above, the 8 gray voltage levels are applied in the preferred embodiment of the present invention, however, the technical scope of the present invention is not limited to this.

The operation of the gray voltage generator for liquid crystal display capable of controlling a viewing angle according to the embodiment of the present invention will be explained.

Figure 4:
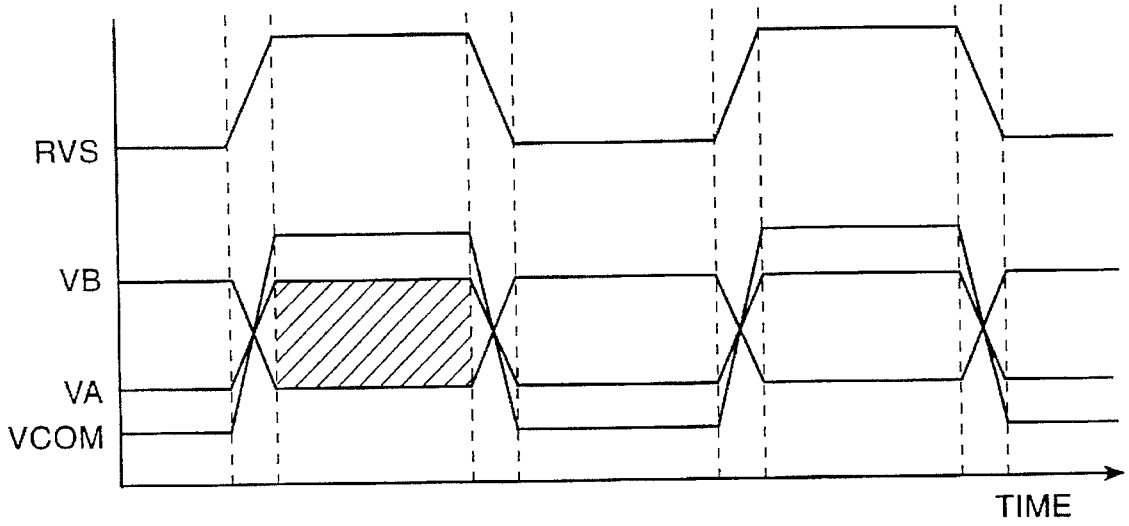
FIG. 4 is a wave form chart for each part of the gray voltage generator for a liquid crystal display capable of controlling a viewing angle according to the preferred embodiment of the present invention.

When a reverse signal RVS from a microcontroller 1 of a liquid crystal display is applied to the inverting input terminal of the operational amplifier OP1 and the noninverting input terminal of the operational amplifier OP2, the operation of the circuit begins. As shown in FIG. 4, the reverse signal RVS is in-phase with a waveform of a common electrode VCOM applied to the liquid crystal of a TFT drain terminal of a liquid crystal panel 5.

The operational amplifier OP1 is operated as the inverting amplifier and produces a reverse phase signal VB of the inputted reverse signal RVS. The operational amplifier OP2 is operated as the noninverting amplifier and produces an in-phase signal VA of the inputted reverse signal RVS. FIG. 4 illustrates waveforms of the output terminal signals VA and VB of each operational amplifier OP1 and OP2.

Potential difference having opposite polarity from each other during every reverse period are alternatively formed at the output of the seven resistors R1 to R7 connected in the voltage divider 23 because the output signals of each operational amplifier OP1 and OP2 are always in reverse phase with each other. The potential difference is thus divided by each resistor R1 to R7, and gray voltage 8 levels V1 to V8 is produced from the output terminals of each resistor R1 to R7. The gray voltage of 8 levels V1 to V8 is sequently formed repeating descending order or ascending order at every reverse period.

For example, if the voltage of the output terminal VB of the operational amplifier OP1 is 5.0 V, the voltage of the output terminal VA of the operational amplifier OP2 is 1.5 V, and resistance values of each resistor R1 to R7 are the same, the gray voltage V1 to V8 is formed in an order of 5.0 V, 4.5 V, . . . , 2.0 V and 1.5 V. On the contrary, the gray voltage V1 to V8 is formed in the order of 1.5 V, 2.0 V, . . . , 4.5 V and 5.0 V at a next period.

Figure 5:
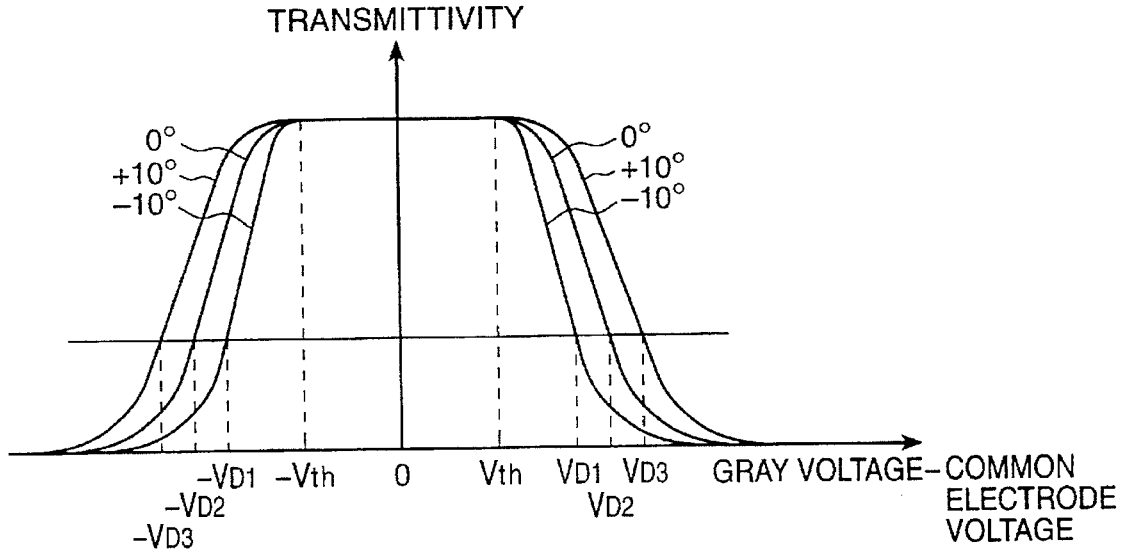
Fig. 5 (PRIOR ART)
FIG. 5 is a schematic illustration of the interrelation of applied voltage and transmittivity according to a viewing angle of the conventional liquid crystal display.

FIG. 5 is a schematic illustration of the interrelation of applied voltage and transmittivity according to a viewing angle of the conventional liquid crystal display to explain a function for controlling the viewing angle in the gray voltage generator for a liquid crystal display operated as described above. The applied voltage of the liquid crystal is the voltage applied to the liquid crystal of a liquid crystal panel 5, and corresponds to the potential difference between the gray voltage selected by a source driver 3 and voltage of a common electrode VCOM.

Referring to FIG. 5, the voltage applied to the liquid crystal is different for different viewing angles for the same transmittivity. Accordingly, when amplitude of VB wave form in FIG. 4 is adjusted, the applied voltage of the a liquid crystal is adjusted, thereby controlling the viewing angle. The amplitude of the VB wave form may be adjusted by controlling the resistance value of the variable resistor VR1 connected between the inverting input terminal and the output terminal of the operational amplifier OP1. The amplitude of wave form of the output terminal VB of the operational amplifier OP1 is proportional to VR1/R211.

In addition, since the gray voltage-kick back voltage is applied to the liquid crystal, when the gray voltage is applied to the liquid crystal, it has a bad influence on image quality of the liquid crystal. Accordingly, the entire levels of gray voltage should be shifted by a size of kick back voltage to compensate voltage drop by the kick back voltage when the gray voltage is produced.

In order to shift the entire levels of the gray voltage in the preferred embodiment of the present invention, the voltage of the output terminals VA and VB of each operational amplifier OP1 and OP2 are shifted. First, to shift the voltage of the output terminal VB of the operational amplifier OP1, the variable resistor VR5 is connected to the noninverting input terminal of the operational amplifier OP1, and second, to shift the voltage of the output terminal VA of the operational amplifier OP2, the variable resistor VR3 is connected to the inverting input terminal of the operational amplifier OP2.

The voltage of the output terminal VB of the operational amplifier OP1 may be shifted by adjusting the resistance value of the variable resistor VR5, and the voltage of the output terminal VA of the operational amplifier OP2 may be shifted by changing the output voltage of the operational amplifier OP3 by adjustment of the resistance value of the variable resistor VR2.

On the other hand, the threshold voltage is the voltage applied to the liquid crystal at which the transmissivity amounts to one hundred percent. The threshold voltage may vary somewhat depending upon the kind of liquid crystal.

Conventionally, the amplification ratio of the operational amplifier of the gray voltage generator is set considering the threshold voltage. However, the voltage drop due to the threshold voltage of different liquid crystals various according to the kind of liquid crystal. In the present invention, these variations are compensated for by adjusting the amplitude of reference wave form of the voltage.

In order to obtain a consistent voltage drop, the amplitude of the voltage of the output terminal VA of the operational amplifier OP2 is controlled by the resistance value of the variable resistor VR3 and the amplification ratio of the operational amplifier OP2 is expressed as (1+VR3/R3).

When the liquid crystal display operated as described above is applied to a notebook computer or a laptop computer, an abnormal screen may be displayed by the liquid crystal display during a setup time before a video signal is produced from a main board of the computer after power is applied to the computer.

The abnormal screen is displayed when early voltage of a source driver 3 is applied to the liquid crystal panel 5. This problem can be solved by initializing the voltage value of the gray voltage generator by the early screen controller 24 connected to the inverting input terminal of the operational amplifier OP1 in the embodiment of the present invention.

The clock signal SCLK in the early screen controller 24 is produced from the main board of the computer. When the main board is operated and the video signal RGB starts to be produced, a pulse string signal is applied and low-level is kept before the application of the pulse string signal.

The AND element 242 and the T-flip-flop 241 of the early screen controller 24 is for determining whether the clock signal SCLK is produced or not. When the clock signal is not produced, the high-level signal is produced from an output terminal /Q of the T-flip-flop 241, and when the clock signal is produced, the low-level signal is produced from the output terminal /Q of the T-flip-flop 241.

The resistance value of the variable resistor VR4 of the early screen controller 24 is expressed by a following relation where Vp is collector potential of the transistor Q and Vr is reference voltage.

$$R4 = -\frac{R211 \times VR1\,(Vp - Vr)}{Vr \times VR1 + Vr \times R211}$$

When the resistance value of the variable resistor VR4 is set as described above and the clock signal SCLK is not produced, the high-level signal is applied to an emitter terminal of the transistor Q and inverted by the operational amplifier OP1, thereby the voltage of the output terminal VB of the operational amplifier OP1 becomes a ground level. The voltage of the output terminal of the operational amplifier OP2 carrying out the noninverting and amplification operation becomes low-level because the reverse signal RVS is also low-level during the setup time.

Accordingly, since the potential difference is not formed between each resistor R1 to R7 of the voltage divider 23, the levels of the gray voltage V1 to V8 become the same and are selected in the source driver 3, and thereby the voltage applied to the liquid crystal panel 5 also has the same levels.

When the clock signal SCLK is normally produced after the setup time of the computer, the output terminal of the T-flip-flop 241 is toggled to the low-level, the transistor is turned OFF, such that the operation of the early screen controller 24 is suspended.

In the construction according to the preferred embodiment of the present invention, the operational amplifier and the flip-flop may be replaced by other means, and besides the computer, the present invention can be applied to application electrical equipments like a liquid crystal television set, a camcorder, viewfinder and the like within the technical scope of the present invention.

As described above, in the preferred embodiment of the present invention, the gray voltage generator for liquid crystal display which can control the viewing angle of the liquid crystal by adjustment of the amplitude of the gray reference voltage, compensate the voltage drop by the kick back voltage and threshold voltage of the liquid crystal, and prevent the abnormal screen display during the setup time when applied to application electrical equipment.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

What is claimed is:

1. A gray voltage generator for a liquid crystal display capable of controlling a viewing angle, said liquid crystal using one of a plurality of types of liquid crystals, each of said plurality of types of liquid crystals having at least one different characteristic which affects said viewing angle, comprising:

first means for inverting and amplifying a reverse signal from a microcontroller in a liquid crystal display to produce a reverse phase signal having a first controlled voltage level, said first means including first adjustment means that compensates said first controlled voltage level for said characteristic of said one liquid crystal type;

second means for amplifying said reverse signal from the microcontroller in the liquid crystal display to produce an in-phase signal having a second controlled voltage level, said second means including second adjustment means that compensates said second controlled voltage level for said characteristic of said one liquid crystal type; and third means having terminals connected to output signals from said first and second means for producing a plurality of gray voltages each having a sequentially different potential and having a plurality of serially connected resistors connected between said terminals.

2. A gray voltage generator for a liquid crystal display capable of controlling a viewing angle according to claim 1, further comprising fourth means for preventing a screen displayed abnormally by a liquid crystal panel by making said first and second controlled levels the same when a clock signal is not produced during a set up time.

3. A gray voltage generator for a liquid crystal display capable of controlling a viewing angle according to claim 1, wherein said first adjustment means adjusts an amplitude of said reverse phase signal to compensate for said characteristic of said one liquid crystal type; and said first means further includes means for compensating a kick back voltage drop in said liquid crystal by further adjusting the amplitude of said reverse phase signal.

4. A gray voltage generator for a liquid crystal display capable of controlling a viewing angle according to claim 1, wherein each of the first and second adjustment means compensates for a voltage drop due to a threshold voltage of said one liquid crystal type.

5. A gray voltage generator for a liquid crystal display capable of controlling a viewing angle according to claim 2, wherein the fourth means includes an AND element, and a T-flip-flop for determining whether a clock signal is produced;

transistor means which turn ON when the clock signal is not produced and a high-level signal is produced from said T-flip-flop; and means for making the level of said first and second controlled levels the same by applying the high-level signal to the first means when the transistor means is turned ON.

6. A gray voltage generator for a liquid crystal display capable of controlling a viewing angle according to claim 1, wherein said characteristics of said one type of a liquid crystal is a threshold voltage.

7. A gray voltage generator for a liquid crystal display capable of controlling a viewing angle according to claim 3, wherein said second adjustment means adjusts an amplitude of said in-phase signal to compensate for said characteristic of said one liquid crystal type; and said second means further includes means for compensating for a kick back voltage drop in said liquid crystal by further adjusting the amplitude of said in-phase signal.

8. A gray voltage generator for a liquid crystal display capable of controlling a viewing angle, said liquid crystal display using one of a plurality of types of liquid crystals, each of said plurality of types of liquid crystals having at least one different characteristic affects said viewing angle, comprising:

first means for inverting and amplifying a reverse signal from a microcontroller in a liquid display to produce a reverse phase signal having a first controlled voltage level;

second means for amplifying said reverse signal from the microcontroller in the liquid crystal to produce an in-phase signal having a second controlled voltage level;

third means of having terminals connected to output signals from said first and second means for producing a plurality of gray voltages each having a sequentially different potential and having a plurality of serially connected resistors connected between said terminals; and fourth means for preventing a screen displayed abnormally by a liquid crystal panel by making said first and second controlled levels the same when a clock signal is not produced during a set up time.

9. A gray voltage generator for a liquid crystal display capable of controlling a viewing angle according to claim 8, wherein:

said first means includes first adjustment means that compensates said first controlled voltage level for said characteristic of said one a liquid crystal type; and said second means includes second adjustment means that compensates said second controlled voltage level for said characteristic of said one a liquid crystal type.

10. A gray voltage generator for a liquid crystal display capable of controlling a viewing angle according to claim 9, wherein said characteristics of said one type of a liquid crystal is a threshold voltage.

11. A gray voltage generator for a liquid crystal display capable of controlling a viewing angle according to claim 8, wherein the fourth means includes an AND element, and a T-flip-flop for determining whether a clock signal is produced;

transistor means which turn ON when a clock signal is not produced and a high-level signal is produced from said T-flip-flop; and means for making the level of said first and second controlled levels the same by applying the high-level signal to the first means when the transistor means is turned ON.

* * * * *